US006481023B2

(12) United States Patent
Wise et al.

(10) Patent No.: US 6,481,023 B2
(45) Date of Patent: Nov. 19, 2002

(54) SUSPENSION FOR PROTECTIVE HEADGEAR

(75) Inventors: Layton A. Wise, Washington, PA (US); James A. Hendrickson, Freedom, PA (US); Glenn C. Davis, Apollo, PA (US); James G. Tomlinson, Pittsburgh, PA (US); Paul A. Zeller, Pittsburgh, PA (US)

(73) Assignee: Mine Safety Appliances Company, Pittsburgh, PA (US)

( * ) Notice: Subject to any disclaimer, the term of this patent is extended or adjusted under 35 U.S.C. 154(b) by 0 days.

(21) Appl. No.: 09/939,364

(22) Filed: Aug. 24, 2001

(65) Prior Publication Data

US 2002/0000004 A1 Jan. 3, 2002

Related U.S. Application Data

(63) Continuation of application No. PCT/US00/04621, filed on Feb. 23, 2000.
(60) Provisional application No. 60/121,615, filed on Feb. 25, 1999.

(51) Int. Cl.[7] ..... A42B 3/00
(52) U.S. Cl. ..... 2/416; 2/418
(58) Field of Search ..... 2/417, 416, 411, 2/418, 419, 420, 181, DIG. 11

(56) References Cited

U.S. PATENT DOCUMENTS 3,127,615 A * 4/1964 Aileo
3,156,922 A * 11/1964 Anderson
3,696,440 A * 10/1972 Littleton
3,696,441 A * 10/1972 Littleton
3,906,548 A * 9/1975 Kallis
4,106,127 A * 8/1978 Marangoni et al.
5,058,210 A * 10/1991 Tivis
5,898,949 A * 5/1999 Barthold et al.

* cited by examiner

*Primary Examiner*—Rodney M. Lindsey
(74) *Attorney, Agent, or Firm*—James G. Uber; Henry E. Bartony, Jr.

(57) ABSTRACT

A suspension for a protective helmet having a headband section that encompasses at least a part of a user's head and a crown support section connected to the headband section. The headband section and the crown support section of the suspension are fabricated from an integral piece of material. The suspension system may also have a headband comprising a section of elastic material. Alternatively, the headband may comprise a forward band having a first section to contact the forehead of the user and a second section adapted to be positioned between the user's head and the crown support section of the suspension during use thereof.

15 Claims, 7 Drawing Sheets

SUSPENSION FOR PROTECTIVE HEADGEAR

This application is a continuation International Application PCT/US00/04621 filed on Feb. 23, 2000 and which designated the U.S. and claims benefit of No. 60/121,615, filed Feb. 25, 1999.

FIELD OF THE INVENTION

The present invention relates to a suspension, and particularly, to a suspension for protective headgear such as a protective helmet.

BACKGROUND OF THE INVENTION

Most types of protective headgear worn by workers to protect them from head injury have a suspension system. The suspension system, along with the helmet itself, act to absorb the shock of an impact with any object striking the worker's head. The suspension system is also used to position the helmet on the worker's head.

The suspension is often a web-like support system comprising several strips of material that are arranged to cross each other. The ends of the strips are, for example, attached at four or more points around the circumference of the helmet. A band or headband is then typically attached to the four or more points of the suspension to permit the helmet to be worn by the worker. To securely position the helmet on the worker's head, it is essential that the circumference of the headband be adjustable to fit the appropriate head size. A napestrap is often attached at a rearward end of the band to achieve these results.

For example, in the Staz-On® Suspension from Mine Safety Appliances Company of Pittsburgh, Pa., and described in U.S. Pat. Nos. 3,500,474 and 5,896,586 a headband, and more particularly, the napestrap portion of the headband, is manually adjusted by the wearer to fit the appropriate head size. The two ends of the band are connected and held in place by a slot-and-teeth arrangement. In the Fas-Trac® Suspension from Mine Safety Appliances Company, and described in U.S. Pat. Nos. 4,942,628 and 5,950,245, a ratchet-type mechanism is used to control the fit of the headband.

In commercially available suspensions for use with protective headgear, the supporting webbing and the headband are generally fabricated from three or more components, requiring relatively expensive and time consuming assembly. It is, therefore, desirable to develop a suspension for protective headgear which is comfortable, easily adjustable to the head size of the user, as well as simple and inexpensive to manufacture.

SUMMARY OF THE INVENTION

Generally, the present invention provides a suspension for use in protective headgear. The suspension comprises a headband section to encompass at least a part of a user's head and a crown support section connected to the headband section. The crown support section is adapted to extend over the crown of a person's head during use of the suspension. The headband section and the crown support section of the suspension are fabricated from an integral piece of material. As used herein, the term "integral" and the phrase "integral piece of material" refer to a single piece of material that is a seamless whole.

Preferably, the suspension is fabricated from an integral piece of polymeric material. Preferably, the polymeric suspension is molded in a generally flat mold. The headband section preferably comprises at least a first opening or disconnection therein and a second opening or disconnection therein during molding to facilitate generally flat molding. Fabricating the suspension of the present invention from an integral piece of material, and particularly a generally flat, integral piece of molded polymeric material, greatly reduces the labor and manufacturing costs associated with protective headgear. Moreover, because the suspension of the present invention is molded in a generally flat, disconnected state, it can be easily stacked for storage and/or shipment.

The suspension preferably further comprises attachment tabs for attaching the suspension to the shell of the protective helmet. These attachment tabs are preferably formed integrally with the remainder of the suspension (that is, the tabs are part of the integral piece of material). The crown support section of the suspension of the present invention preferably comprises at least two crown straps connected at a first end thereof to the headband section and connected at a second end thereof to a generally central section. The generally central section is preferably adapted to contact the top of the user's head during use of the suspension.

A portion of the crown support section preferably deforms when the protective headgear has sustained an impact of a certain force. Preferably, a portion of at least one of the crown straps deforms when the protective headgear has sustained an impact of a certain force. This deformation of a portion of the crown support section acts to absorb some of the energy of the impact. Preferably, the portion of the crown support section deforms sufficiently to provide a readily visible indication that the protective headgear has sustained the impact.

For example, the portion of the crown support section that deforms may comprise a first opening in the crown strap that visibly deforms when the protective headgear has sustained an impact. That portion of the crown support section may also comprise a second opening adjacent the first opening. In this embodiment, a strip of material between the first opening and the second opening is preferably adapted to break when the protective headgear has sustained an impact of a certain force. Additional holes may also create high stress areas that deform and/or break when the protective headgear has sustained an impact of a certain force.

The present invention also provides a suspension including a headband comprising an elastomeric portion. The inventors of the present invention have discovered that a headband comprising a length of even slightly elastomeric material greatly increases the comfort of the user when compared to certain commercially available suspension systems. Moreover, the present inventors have discovered a length of elastomeric material can be incorporated into a headband of a suspension for protective headgear while still complying with Top Impact Standard ANSI Z89.1-1997 for such protective headgear.

In one embodiment, the length of the elastomeric material spanning the opening in the headband section is preferably adjustable to adjust the fit of the suspension. In another embodiment, the opening is closed and the headband section is provided with a mechanism for attaching the elastomeric material.

In the suspension described above, for example, a limited elastomeric band or portion may span the first opening of the headband section. This limited elastomeric band section contacts the forehead of the user. The limited forward elastomeric band section is preferably formed from a material which is suitable to cushion the user's head and may also act as a sweatband. Alternatively, the two front arms of the headband section may be connected together, eliminating the first opening. This section is then covered with a soft flexible material to cushion the user's head and also act as a sweatband.

The present invention also provides a forward band section comprising in one embodiment a first or forward section to contact the forehead of the user and a second or upward section adapted to be positioned between the user's head and the crown support section of the suspension during use thereof. The forward band section is preferably formed from a material suitable to cushion the user's head. The first section of the forward band section and the second section of the forward band section are preferably formed from an integral piece of material. Unlike prior forward bands or sweatbands incorporated into protective headgear, the second section of the forward band section of the present invention cushions the top of the user's head from contact with the crown support section of the suspension, thereby substantially increasing the comfort of the user. As described above, the forward band section is preferably elastic in nature.

The present invention also provides protective helmets comprising suspension systems and/or forward band sections as described above.

DETAILED DESCRIPTION OF THE INVENTION

Figure 1:
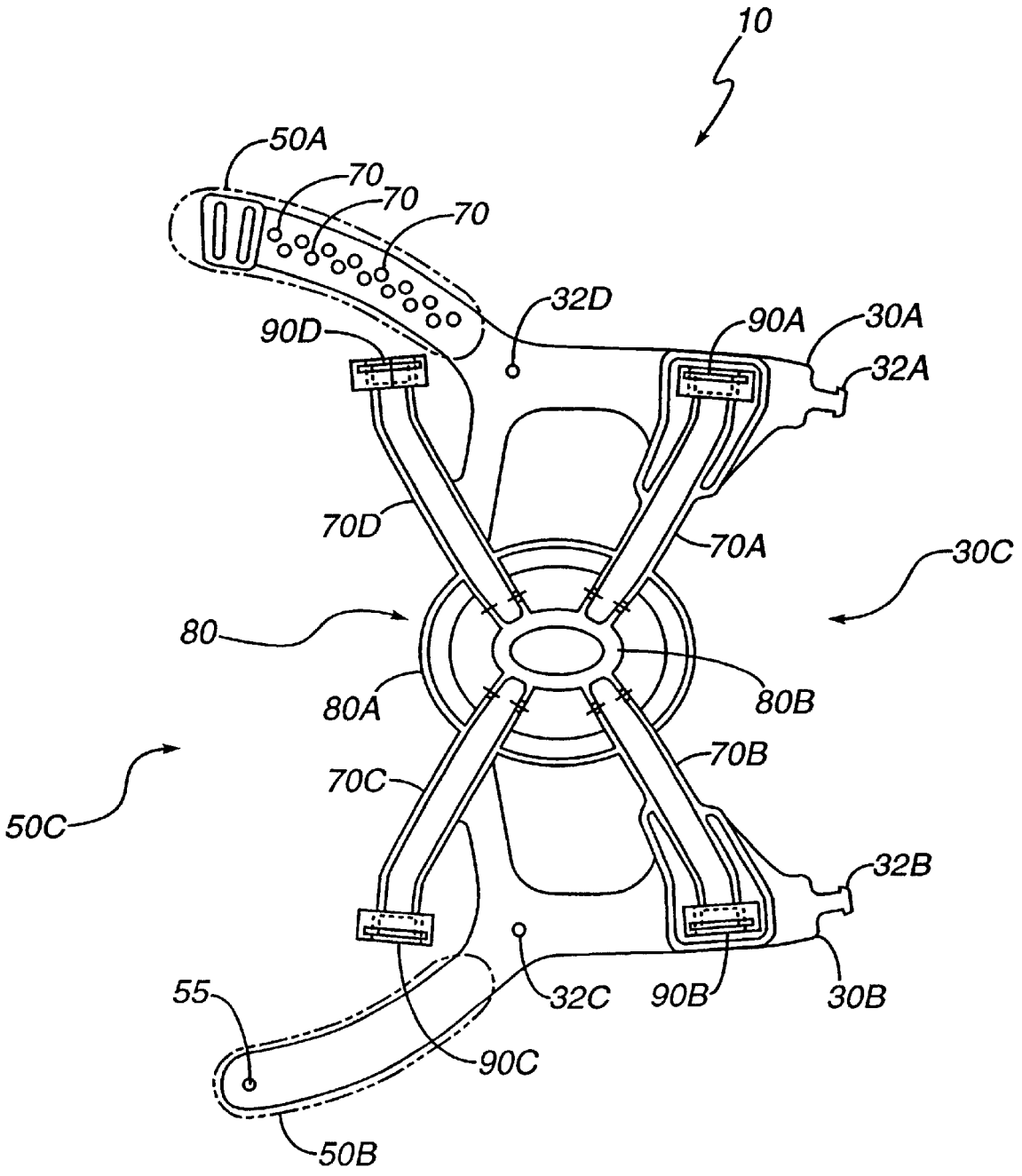
FIG. 1 illustrates a top plan view of one embodiment of a suspension of the present invention in a disconnected, generally flat state.

As illustrated in FIG. 1, a suspension 10 for use in a protective helmet 20 (see FIGS. 2, 3A and 3B) is preferably formed from an integral piece of material. Preferably, the material is a moldable polymeric material having a modulus in the range of approximately 20,000 to 50,000 psi, more preferably in the range of approximately 30,000 to 40,000 psi. As is clear to one skilled in the art, the range of preferred moduli can be changed if the dimensions (for example, thickness) of suspension 10 are changed. An example of a suitable material is polyethylene. Suspension 10 comprises a headband section 30 (see FIG. 3B) to encompass at least a part of the side of a user's head and a crown support section 40 (see FIG. 3B) connected to headband section 30. Crown support section 40 extends over the crown of the user's head during use of suspension 10.

As further illustrated in FIG. 1, suspension 10 is preferably formed such that headband section 30 comprises a first forward end 30A and a second forward end 30B with a first opening 30C therebetween. After molding, first forward end 30A and second forward end 30B may be connected together in forming the headband of suspension 10. In connecting first forward end 30A and second forward end 30B, suspension 10 begins to take a three-dimensional domed shape as best illustrated in FIG. 3B.

Figure 3A:
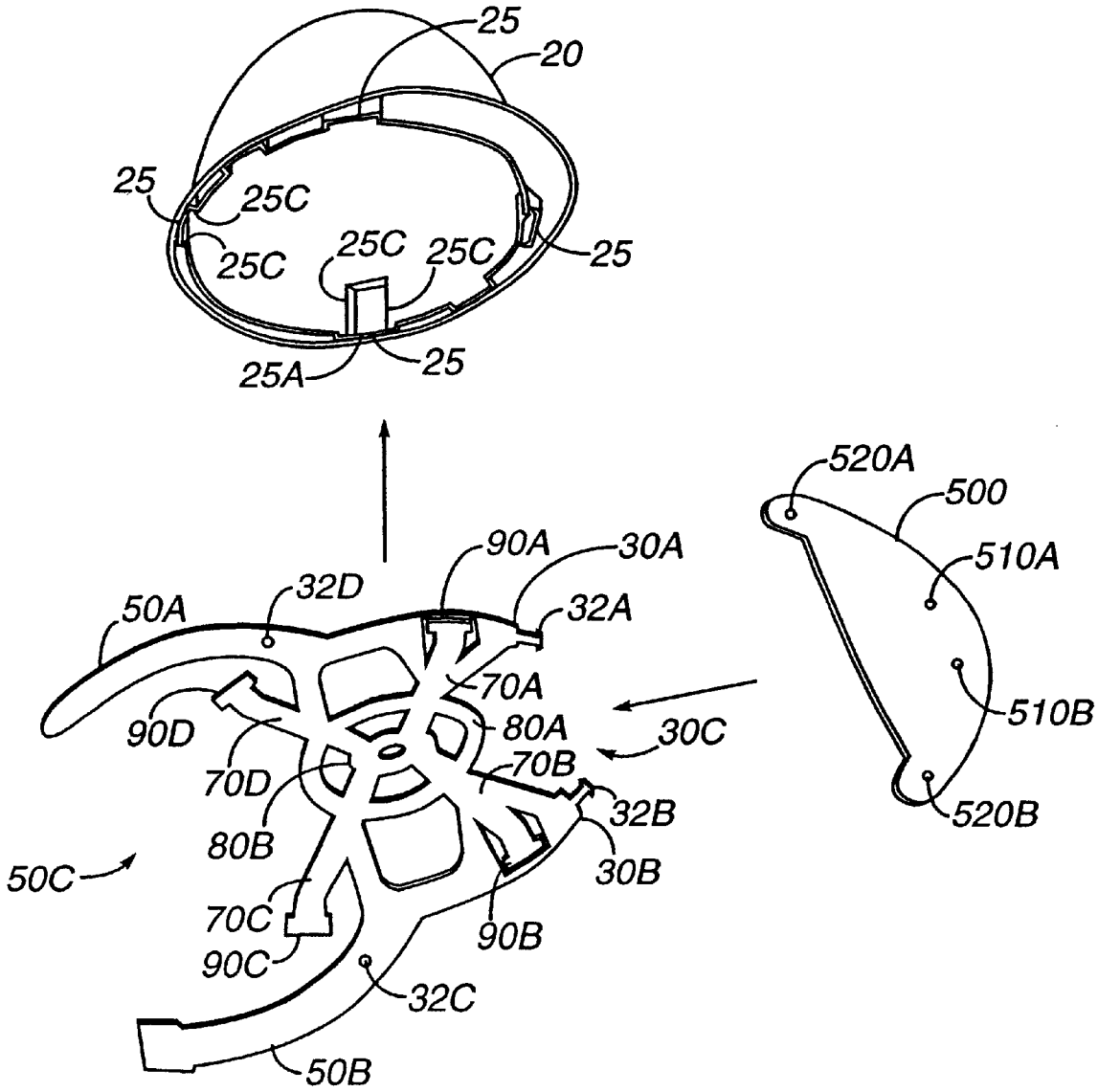
FIG. 3A illustrates the suspension of FIG. 1 and a helmet and a forward band for use therewith in a disconnected state.
Figure 3B:
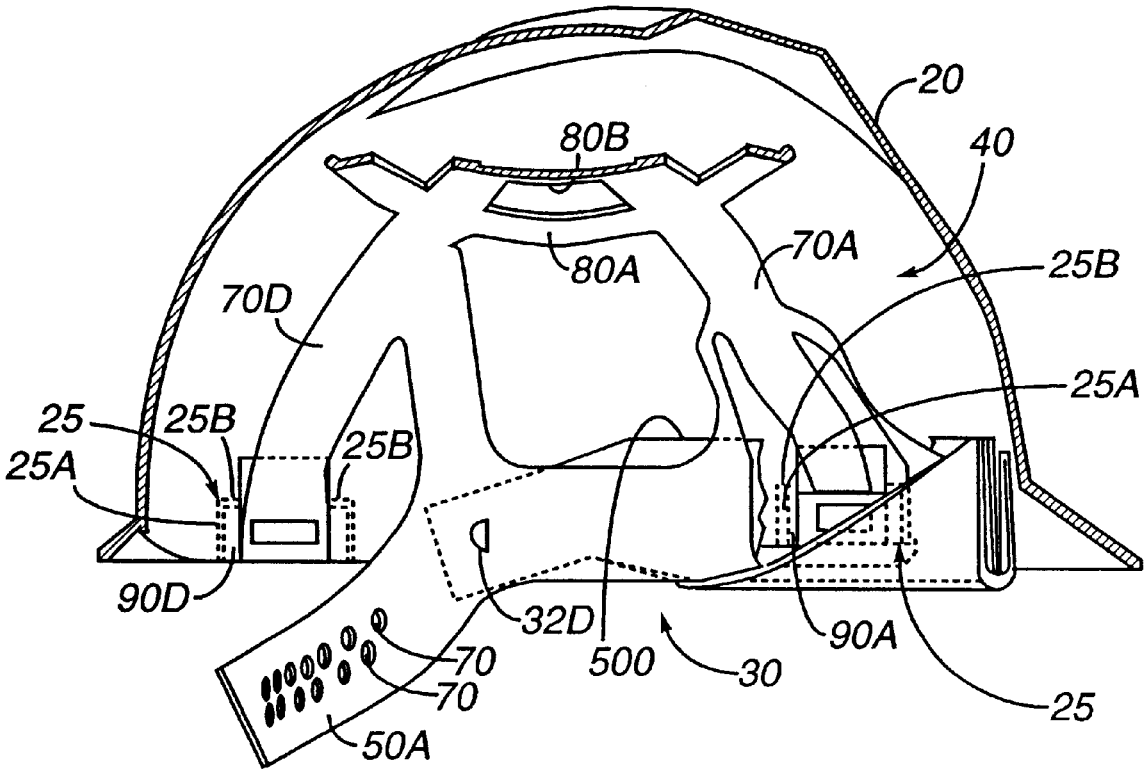
FIG. 3B illustrates a cross-sectional view of the suspension, helmet and forward band of FIG. 3A in a connected three-dimensional state.

In one embodiment, first forward end 30A and second forward end 30B are not directly connected together when suspension 10 is in a connected state (illustrated in FIG. 3A and 3B). In that regard, headband section 30 preferably further comprises a forward band 500 that connects between first forward end 30A and second forward end 30B to span first opening 30C. Forward band 500 is preferably connected to span first opening 30C via tabs 32A and 32B on first forward end 30A and second forward end 30B, respectively. Tabs 32A and 32B preferably cooperate with slots 510A and 510B, respectively, of forward band 500 to removably incorporate forward band 500 into headband section 30. Headband section 30 preferably further comprises tabs 32C and 32D that cooperate with holes or slots 520A and 520B, respectively, to further retain forward band 500 within headband section 30. Forward band 500 preferably acts to cushion the fit of headband section 30 on the user's head and as a sweatband to absorb perspiration of the user. Forward band 500 is discussed in further detail below.

Figure 2:
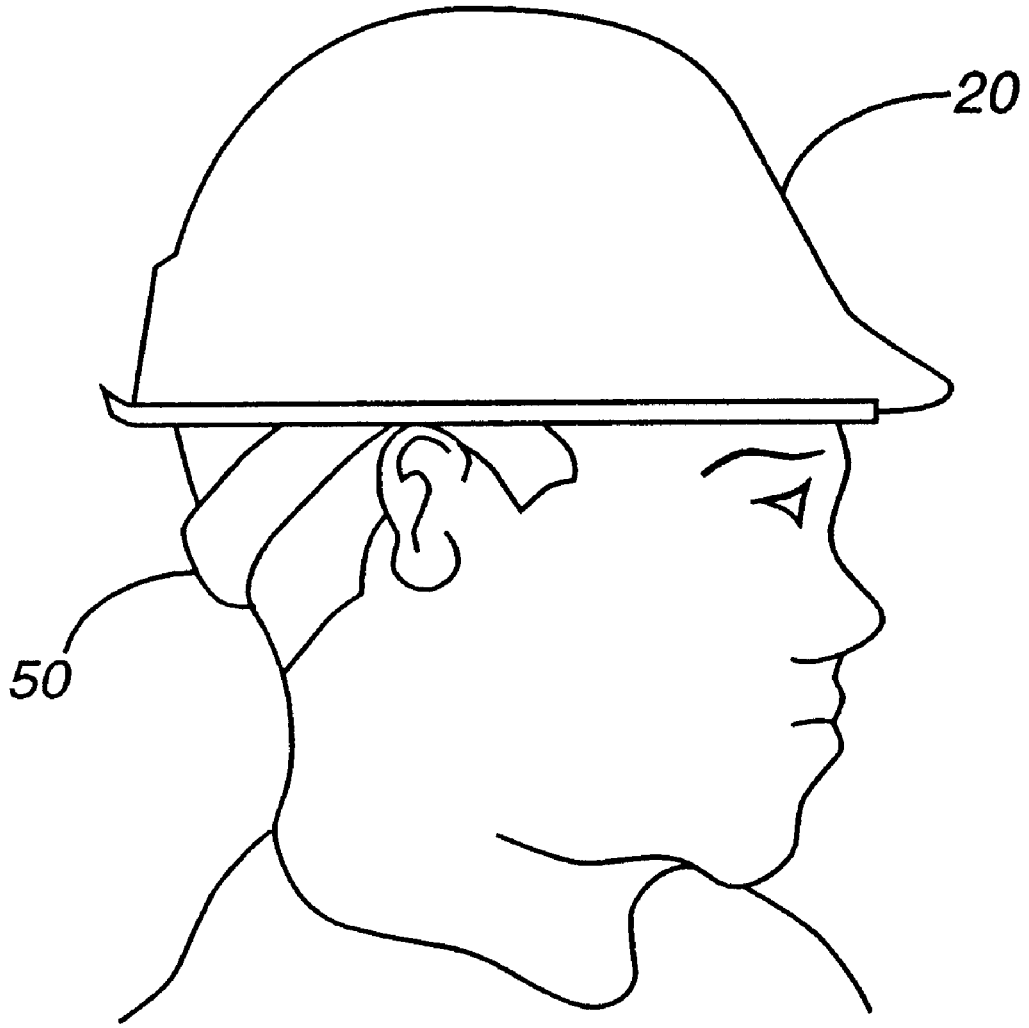
FIG. 2 illustrates a protective helmet in which the suspensions of the present invention may be used.

In the embodiment of FIG. 1, headband section 30 comprises a nape strap 50 on the rearward side thereof that extends around the base of the user's head as best illustrated in FIG. 2. Before connection, nape strap 50 comprises a first rearward end section 50A and a second rearward end section 50B, forming a second opening 50C therebetween. Second rearward end section 50B may, for example, comprise a tab 55 that cooperates with one of a plurality of slots or holes 70 in first rearward end section 50A to connect first rearward end section 50A and second rearward end section 50B and to adjust the fit of headband 30 to the user's head. Other manners of connecting first rearward end section 50A and second rearward end section 50B to adjust the fit of headband 30 to the user's head such as with a ratchet mechanism are known in the art and are equally suitable for use in the present invention.

Fabricating suspension 10 such that headband section 30 is separated in the front (relative to the user, i.e., the right side in FIG. 1) to form first opening 30C and separated in the rear (i.e., left side of FIG. 1) to form second opening 50C enables one to make suspension 30 as generally flat or two-dimensional in a disconnected state. This generally flat profile enables the molding of suspension 10 out of a polymeric material in a generally flat mold, greatly simplifying the fabrication of suspension 10 and decreasing the cost thereof as compared to commercially available suspensions for use with protective headgear.

The flat profile of suspension 10 also facilitates the stacking of a plurality of such suspensions for storage and/or shipment. Under current practice, suspensions are typically attached to a protective helmet and the helmets (with suspension therein) are shipped in individual boxes. Because of the flat profile of suspension 10 and the ease with which suspension 10 can be attached to or removed from helmet 20, suspension 10 and helmet 20 can be readily shipped in a disconnected state. In that regard, helmet 20 is preferably formed such that a plurality of such helmets can be stacked/nested for ease of storage and/or shipment.

Crown support section 40 of suspension 10 preferably comprises crown straps 70A, 70B, 70C and 70D. Crown straps 70A through 70D preferably connect headband section 30 to a generally central section 80. Generally central section 80 is preferably formed to contact the top of the user's head during use of suspension 10. In the embodiment of FIG. 1, each of crown straps 70A through 70D is attached to each of a first generally circular portion 80A and a second generally circular portion 80B that comprise generally central section 80.

Suspension 10 preferably further comprises an attachment mechanism for attaching suspension 10 to helmet 20. As discussed above, the attachment mechanism preferably allows easy attachment and disconnection of suspension 10. Preferably, the attachment mechanism is formed integrally with the remainder of suspension 10. For example, suspension 10 may comprises tabs 90A through 90D on the ends of crown straps 70A through 70D for readily and removably attaching suspension 10 to helmet 20.

Tabs 90A through 90D preferably cooperate with corresponding ports 25 on helmet 20. Tabs 90A through 90D preferably seat in corresponding ports 25 such that suspension 10 resists removal from helmet 20 during use thereof, but can be removed from helmet 20 when not in use. As illustrated in FIGS. 3A and 3B, ports 25 preferably comprise a channel 25A formed by flanges 25C. Within channel 25A is an abutment member or wall 25B on each side of channel 25A against which tabs 90A through 90D rest when helmet 20 is in use. A central section 25A' of channel 25A preferably extends farther upward past abutment members 25B to seat a lower portion of crown straps 70A through 70D. When helmet 20 is not in use, suspension 10 is easily removable therefrom by simply sliding tabs 90A through 90D downward and out of ports 25.

The present inventors have discovered that a length of elastomeric material can be incorporated into headband 30 of suspension 20 or other suspensions to greatly increase the comfort of the user thereof while safely and fully complying with Top Impact Standard ANSI Z89.1-1997 for protective headgear such as helmet 20. Preferably, the length of elastic material is relatively easily stretched or expanded. For example, a material having a stretch rate of approximately ¼ inch to approximately 3 inches per pound is suitable for use in the present invention. More preferably, the stretch rate is in the range of approximately ½ inch to 2 inches per pound.

It is not necessary that the total amount of stretch afforded by the elastic material be great. Providing only a small amount of flexibility or stretch in headband section 30 can greatly increase the comfort of the user. Elasticity or stretch in headband section 30 of suspension 10, for example, allows the headband section to expand and contract when forces are applied to suspension 10. Moreover, the "vice clamping" effect commonly experienced with certain commercially available suspensions when the head of the user expands during heavy work is greatly reduced or eliminated.

In one embodiment, forward band section 500 can be fabricated to provide elasticity. Forward band section 500 may, for example, comprise a first layer fabricated from a nylon scrim. Such a material is elastic in nature while also providing strength. A nylon scrim also allows moisture to pass therethrough. The strength of the elastic material incorporated into headband section 30 is not a great concern, however, if protection against substantial side impacts is not a concern. The first layer can, for example, be placed against the user's forehead in warm weather to allow the sweat of the user to pass therethrough while maintaining a dry surface. A second layer of forward band section 500 adjacent to the first layer is preferably fabricated from a foam material to provide cushioning and adsorb perspiration. A third layer, adjacent to the second layer on a side thereof opposite to the first layer is also preferably provided. The third layer may, for example, be fabricated from a polyester with a napped or knitted finish. The first layer and the third layer are preferably provided with holes or passages therein to facilitate heat and mass (that is, moisture) transfer therethrough. As illustrated in FIG. 3B forward band section 500 is preferably folded over on itself in the area of the users forehead during use to provide additional padding and comfort.

Forward band section 500 is easily removable from within headband section 30 Because forward band section 500 is preferably formed to be symmetrical in shape, it is also easily reversible within headband section 30. For example, in warm weather, the user of helmet 20 can incorporate forward band section 500 into headband section 30 such that the first layer is against the user's forehead as described above. In cold weather, forward band section 500 may be reversed to place the highly insulating, polyester, third layer against the forehead of the user. As is clear to one skilled in the art, forward band section 500 is also easily replaceable after extended use thereof.

Figure 4:
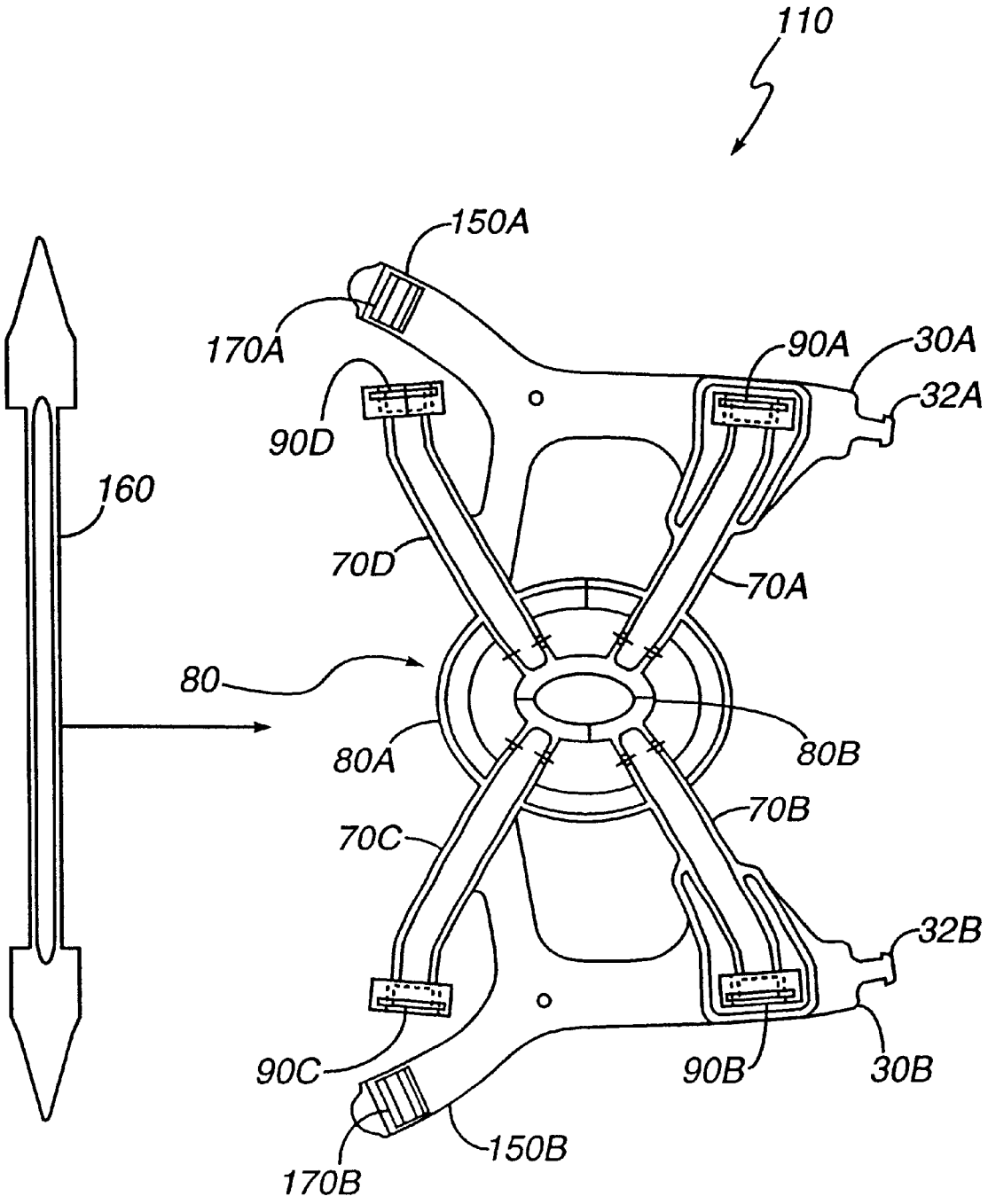
FIG. 4 illustrates a top plan view of a second embodiment of a suspension of the present invention in a disconnected, generally flat state.

An elastic material can also, for example, be incorporated into the rear of a suspension of the present invention. For example, suspension 110 of FIG. 4 is somewhat similar to suspension 10 (with like parts numbered accordingly the same). However, nape strap 150 of suspension 110 comprises a first rearward end section 150A and a second rearward end section 150B that are shortened as compared to first rearward end section 50A and second rearward end section 50B of suspension 10. As illustrated in FIG. 4, first section 150A and second section 150B may be connected or spanned via an elastomeric strap 160 when suspension 110 is assembled into it's three-dimensional form. Alternatively, first rearward end section 50A and second rearward end section 50B of suspension 10 can be used in the suspension 110.

The length of elastomeric strap 160 between first section 150A and second section 150B may be adjusted (to fit the head size of an individual user) via buckles 170A and 170B (as known in the art) formed on the distal ends of first section 150A and second section 150B, respectively.

Figure 5A:
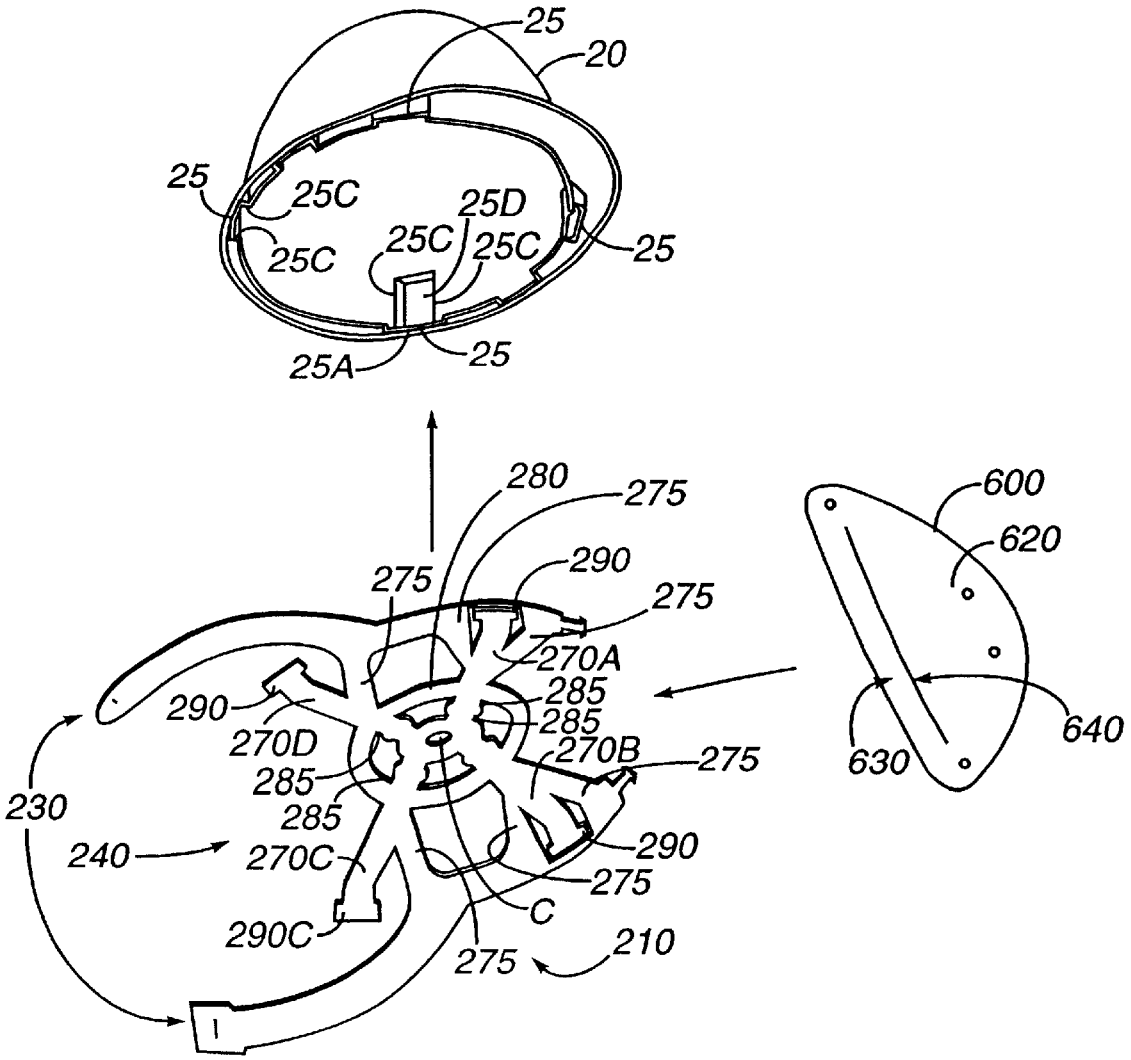
FIG. 5A illustrates another embodiment of a suspension of the present invention in an unconnected, generally flat state.
Figure 5B:
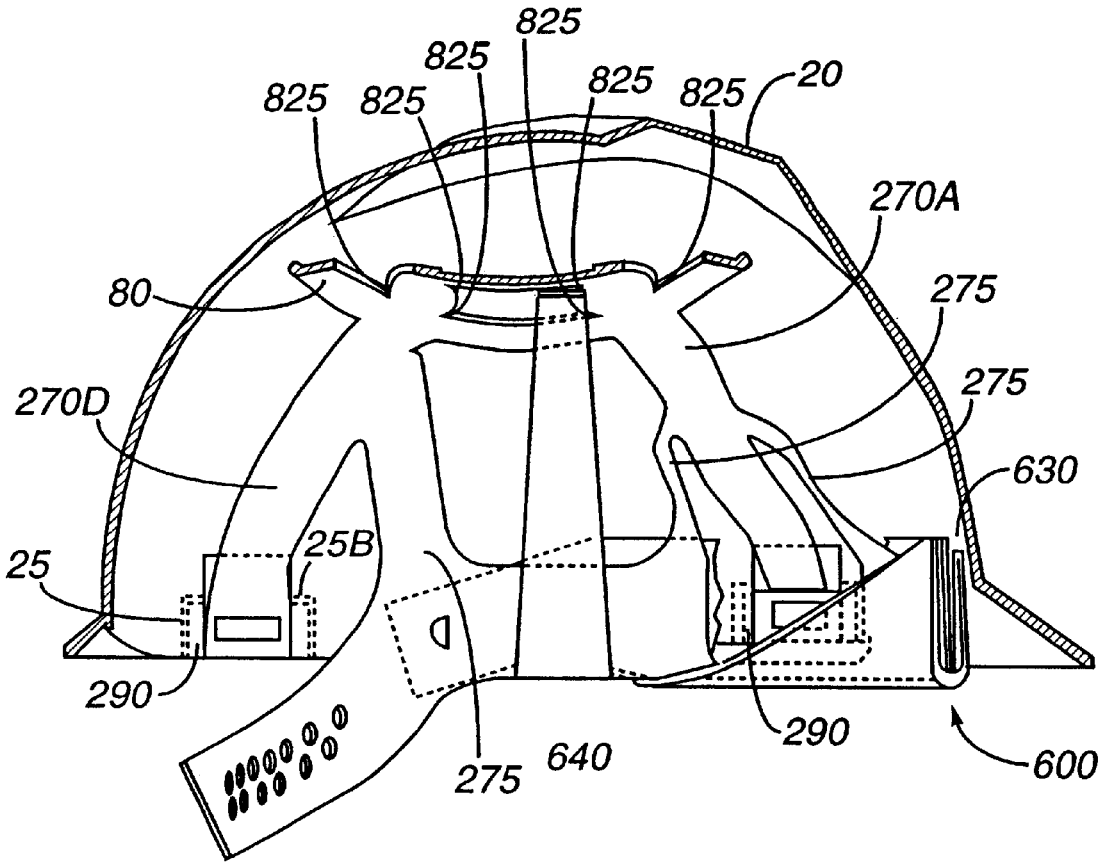
FIG. 5B illustrates a cross-sectional view of the suspension, helmet and forward band of FIG. 5A in a connected three-dimensional state.

In another embodiment, as shown in FIG. 4, first forward end 30A and second forward end 30B are directly connected together when suspension 10 is in a connected state (such as is illustrated in FIG. 5B). Any number of connection mechanisms can be used. A preferred one, as shown in FIG. 4, includes a male member 33 in the shape of an arrow with a slit down the middle and a female member 34 including a ridge with an opening therein such that the arrow can be inserted into the opening in a locking manner. Thereafter a forward band 500 or 600 can be attached to tabs 32A and 32B as described above.

FIGS. 5A and 5B illustrate another embodiment of a suspension 210 of the present invention in which the crown support section thereof comprises at least one section or portion that deforms when the protective headgear in which suspension 210 is used sustains an impact of a certain force. The energy absorbing section(s) are preferably areas of the crown support section of suspension 210 that react to force (for example, stress or strain) differently than the remainder of the crown support section. By deforming upon impact, the energy absorbing sections act to absorb the energy of the impact and also provide a readily visible indication that an impact has occurred.

Upon application of a certain force (which can be calculated/controlled given the material properties and shape of the energy absorbing section), the energy absorbing section(s) preferably deform to a shape different than the original shape thereof. Preferably, the deformation is a permanent viscoelastic or plastic deformation of a molded polymeric suspension 210. Polymeric material having a modulus in the range of 5,000 to 20,000 psi (for example, certain polyethylenes) are preferably used in suspension 210. Upon experiencing a force sufficiently great to cause a given amount of deformation (including, for example, breakage), the deformation will be readily visible or apparent to the user. Upon viewing such a deformation, the user should immediately take the protective headgear out of service.

In the embodiment of FIGS. 5A and 5B, suspension 210 is attached to helmet 20 via tabs 290 that seat in ports 25 of helmet 20 as described above. Headband section 230 is preferably connected to crown straps 270A through 270D via connective members 275 such that little strain from a top impact with helmet 20 is experienced by headband section 230. Because most of the strain resulting from an impact on helmet 20 is experienced in crown straps 270A through 270D of suspension 210, the "energy absorbing" section(s) are preferably located in crown straps 270A through 270D.

In the embodiment of FIGS. 5A and 5B, the energy absorbing sections comprise bulges 285 and holes 286 in crown straps 270A through 270D. Bulges 285 and holes 286 create narrow, high-stress areas in crown straps 270A through 270D that deform sufficiently upon an impact of a substantial force to provide a readily visible indication to the user that such an impact has occurred. With commercially available protective helmets, on the other hand, the user may sustain a substantial impact that has compromised the integrity of the suspension and not be aware that the suspension is damaged.

Preferably, the energy adsorbing sections of suspension 210 are allowed to deform and/or break without substantially jeopardizing the integrity of suspension 210. In that regard, bulges 285 and holes 286 in crown straps 270A through 270D are preferably locate generally near the center portion of crown section 240. A partial halo or ring 280 is preferably provided on each side which connects crown strap 270A to 270D and crown strap 270C to 270D at a point radially outside (relative to center point C in FIG. 5A) of bulges 285 in crown straps 270A through 270D. In this manner, crown straps 270A through 270D can break as a result of an impact in the area of bulges 285 without failure of suspension 210. In that regard, partial halo 280 will remain connected to crown straps 270A through 270D and prevent the head of the user from contacting helmet 20 upon such an impact.

The energy absorbing sections of the present invention can take numerous shapes and dimensions. The energy absorbing section(s) may comprise, for example, one or more generally central passages or holes. In general, the stresses experienced around the edges of a passage or hole are triple in a part under tension as would be experienced in a similar part without such a passage under the same tension. Preferably crown straps 270A through 270D have ridges along each outer edge to increase their strength.

Headband section 230 of the suspension 210 preferably incorporates a forward band section 600. Forward band 600 preferably comprises a forward portion 620 and an upward portion 630. During use, forward portion 620 is preferably incorporated into headband section 230 which has been connected together as described above in connection with forward band section 500. Upon incorporation into headband section 230, upward portion 630 extends upward to be positioned between the crown of the user's head and crown support section 230 of suspension 210. As illustrated in FIGS. 5A and 5B, forward band 600 can be fabricated such that forward portion 620 and upward portion 630 are formed by creating a slit 640 in a piece of material to split forward band 600 into forward portion 620 and upward portion 630. Forward band 600 can thus act to cushion the fit of the suspensions of the present invention on both the forehead and crown and the user. Forward band 600 is thus preferably fabricated from a material or materials as described in connection with forward band section 500.

Although the present invention has been described in detail in connection with the above examples, it is to be understood that such detail is solely for that purpose and that variations can be made by those skilled in the art without departing from the spirit of the invention except as it may be limited by the following claims.

What is claimed is:

1. A suspension for use in a protective helmet, the suspension comprising: a headband section to encompass at least a part of a user's head, a crown support section connected to the headband section, the crown support section adapted to extend over the crown of the user's head during use of the suspension, and a plurality of attachment tabs for attaching the crown support section to a rim of the protective helmet, the headband section, the attachment tabs, and the crown support section being molded to form an integral piece of polymeric material that is generally flat in a disconnected state and wherein the headband section comprises at least a first opening and a second opening therein in the disconnected state to permit to use of a generally flat mold.

2. The suspension of claim 1 wherein the first and second openings in the headband section are eliminated before the protective helmet is worn.

3. The suspension of claim 2 wherein the polymeric material is polyethylene.

4. The suspension of claim 1 wherein the polymeric material has a modulus in the range of approximately 20,000 to 50,000 psi.

5. The suspension of claim 4 wherein the polymeric material has a modulus in the range of approximately 30,000 to 40,000 psi.

6. The suspension of claim 1 wherein the polymeric material is polyethylene.

7. The suspension of claim 1 wherein there are four attachment tabs.

8. The suspension of claim 7 wherein the crown support section is unitary and comprises only one piece of polymeric material.

9. A suspension for use in a protective helmet, the suspension comprising: a headband section to encompass at least a part of a user's bead, a unitary crown support section connected to the headband section, the crown support section adapted to extend over the crown of the user's head during use of the suspension, and at least four attachment tabs for attaching the crown support section to a rim of the protective helmet, the headband section, the attachment tabs, and the crown support section being molded to form an integral piece of polymeric material that is generally flat in a disconnected state.

10. The suspension of claim 9 wherein the headband section comprises at least a first opening and a second opening therein in the disconnected state to permit the use of a generally flat mold.

11. The suspension of claim 10 wherein the first and second openings in the headband section are eliminated before the protective helmet is worn.

12. The suspension of claim 11 wherein the polymeric material is polyethylene.

13. The suspension of claim 9 wherein the polymeric material has a modulus in the range of approximately 20,000 to 50,000 psi.

14. The suspension of claim 13 wherein the polymeric material has a modulus in the range of approximately 30,000 to 40,000 psi.

15. The suspension of claim 9 wherein the polymeric material is polyethylene.

* * * * *